United States Patent [19]

Morgan et al.

[11] Patent Number: 4,995,212

[45] Date of Patent: Feb. 26, 1991

[54] COLLAPSIBLE FRAMEWORK

[75] Inventors: James N. Morgan, St. Albans; Simon A. S. Rivers-Bland, London, both of United Kingdom

[73] Assignee: Marler Haley Exposystems Limited, United Kingdom

[21] Appl. No.: 389,402

[22] Filed: Aug. 4, 1989

[30] Foreign Application Priority Data

Aug. 4, 1988 [GB] United Kingdom ..... 8818550

[51] Int. Cl.[5] ..... E04H 12/18

[52] U.S. Cl. ..... 52/646; 52/109; 52/645

[58] Field of Search ..... 52/645, 646, 109; 40/603, 610

[56] References Cited

U.S. PATENT DOCUMENTS

| | | | |
|---|---|---|---|
| 3,381,923 | 5/1968 | Berry | 52/109 X |
| 4,512,097 | 4/1985 | Zeigler | 52/109 X |
| 4,658,560 | 4/1987 | Beaulieu | 52/646 |
| 4,663,899 | 5/1987 | Nodskou et al. | 52/109 |
| 4,809,471 | 3/1989 | Wichman et al. | 52/646 X |

*Primary Examiner*—Michael Safavi

*Attorney, Agent, or Firm*—Hodgson Russ Andrews Woods & Goodyear

[57] ABSTRACT

A collapsible framework comprises a plurality of spars pivotally connected with hub members. The hub members comprise a first set which are disposed at the front of the framework when erected and a second set which are disposed at the rear of the erected framework, each of said spars being connected at one end with a hub member of the first set and at the opposite end with a hub member of the second set, and the spars being pivotally connected in pairs. The arrangement is such that each hub member of the first set is opposite a respective hub member of the second set and moves nearer to its opposite hub member as the framework is moved from a collapsed to an erected state and moves further from its opposite hub member as the framework is moved from its collapsed to its erected state. Opposite hub members of the first and second sets are connected by tension springs which assist in the unfolding and erection of the framework and provide the forces necessary to hold the frame in its erected position. Vertical braces are detachably connectable between the hub members after the framework has been erected to maintain the framework in position when loaded. These braces are themselves collapsible and are of iron or steel to allow cladding sheets having magnetic securing devices to be fitted to these vertical braces.

4 Claims, 10 Drawing Sheets

COLLAPSIBLE FRAMEWORK

BACKGROUND OF THE INVENTION

This invention relates to a collapsible framework, for example for use as a space divider and support for publicity or information material in temporary exhibitions and the like. More particularly, the invention relates to such a collapsible framework which comprises a plurality of spars pivotally connected with hub members and, where appropriate, with one another, to form a two-dimensionally expanding linkage. Such a framework is herein referred to as being "of the kind specified".

Collapsible frameworks of the kind specified are known, for example from U.S. Pat. No. 4,658,560, and it is an object of the present invention to provide an improved collapsible framework of the kind specified.

SUMMARY OF THE INVENTION

According to one aspect of the invention there is provided a collapsible framework comprising a plurality of spars pivotally connected with hub members, and, where appropriate, with one another, to form a linkage expansible in at least two dimensions, and at least one upright brace, detachably connectable between at least one said hub member and an adjoining said hub member above it, to brace the linkage in an expanded condition and wherein said upright brace is of iron or steel whereby a cladding sheet having magnetic securing means thereon, can readily be attached to said brace.

According to another aspect of the invention there is provided a collapsible framework comprising a plurality of spars pivotally connected with hub members, and, where appropriate, with one another to form an expanding linkage, and at least one upright brace, detachably connectable between at least one said hub member and an adjoining said hub member above it, to brace the linkage in an expanded condition and wherein said upright brace comprises a plurality of rigid lengths detachably connected end-to-end by plug and socket connections and by resilient tensioning means which serve to draw adjacent lengths into interfitting relationship when said lengths are aligned.

According to a yet further aspect of the invention there is provided a collapsible framework comprising a plurality of spars pivotally connected with hub members, and, where appropriate, with one another to form an expanding linkage, and at least one upright brace, detachably connectable between at least one said hub member and an adjoining said hub member above it, to brace the linkage in an expanded condition and wherein said hub members include first hub members which lie on a notional first surface of the erected framework and second hub members which lie on a notional second surface of the erected framework generally parallel with, and spaced from said first surface, each said first hub member being connected, via the spars extending therefrom, with respective said second hub members, and conversely, each said first hub member being directly opposed by a respective said second hub member the spars of which are pivotally connected with the spars of the opposing first hub member, and each said first hub member being connected with the opposing said second hub member by a resiliently extensible tensioning element.

An embodiment of the invention is described below by way of example with reference to the accompanying drawings.

DESCRIPTION OF THE PREFERRED EMBODIMENT

In the preferred embodiment, the framework comprises a plurality of tubular metal spars, all of the same length which are pivotally interconnected as described below.

Figure 1:
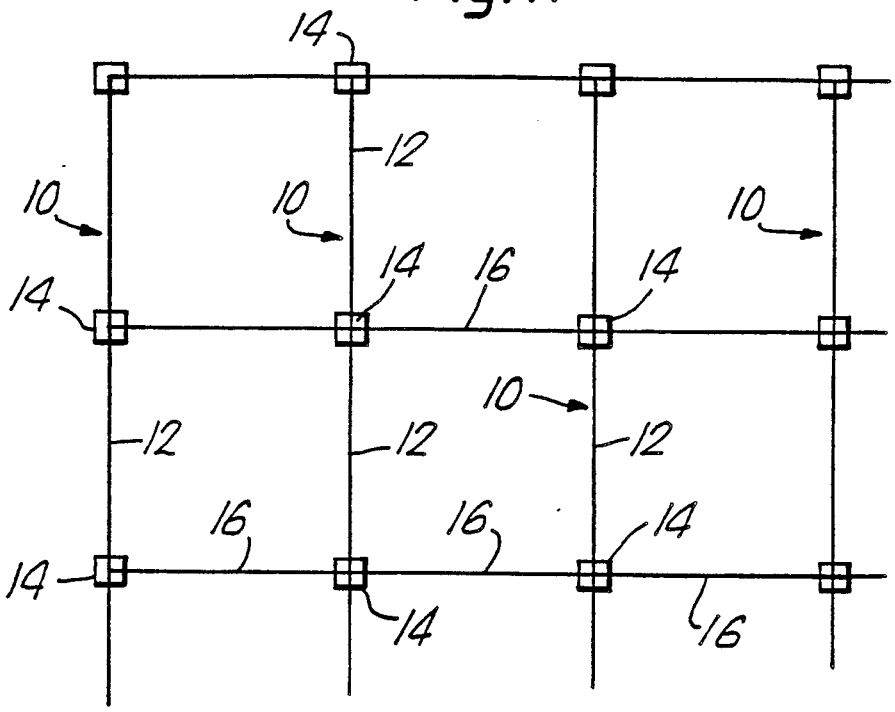
FIG. 1 is a fragmentary schematic front elevation view of an erected framework embodying the invention.
Figure 2:
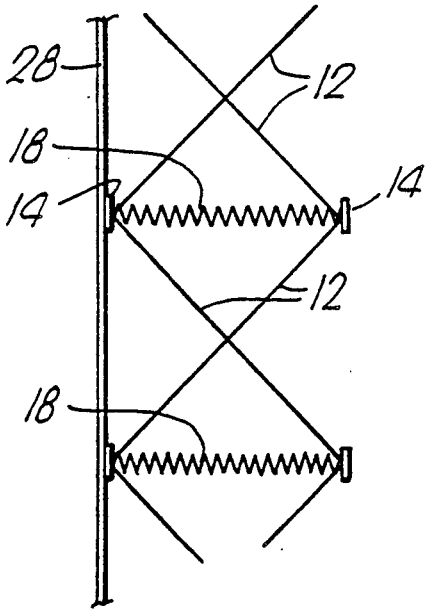
FIG. 2 is a schematic fragmentary end view of the framework of FIG. 1.
Figure 3:
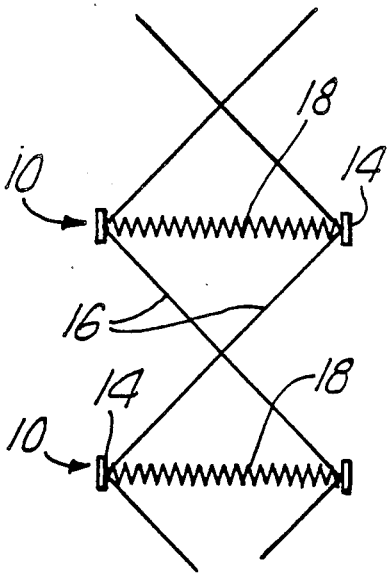
FIG. 3 is a schematic fragmentary top view of the framework of FIGS. 1 and 2.

Referring to FIGS. 1 to 3, the erected framework, in one position thereof, may be regarded as comprising a plurality of vertical linkages interconnected by transverse members, each vertical linkage having the general form illustrated in FIG. 2, and lying approximately in a respective vertical plane extending from front to rear of the erected framework. The vertical linkages are indicated at 10 in FIG. 1. Referring to FIG. 2, each vertical linkage comprises a repeating unit in which crossed diagonal spars 12 are pivotally connected at their lower ends to respective hub units 14, which are at the same horizontal level but are respectively disposed at the front and at the rear of the erected frame, and to which hub units are pivotally connected the upper ends of the diagonals 12, 12 of the unit below, and so on over the full height of the respective vertical linkage.

As illustrated in FIG. 3, as viewed in plan, each vertical linkage 10 is connected with the adjoining linkage 10, at the level of each pair of hub members 14, by diagonally crossed horizontal spars 16, each pivotally connected at one end to the respective hub unit 14 of one vertical linkage lying at the front of the erected framework and pivotally connected, at its opposite end, to the respective hub member 14 of the other vertical linkage, at the rear of the assembled framework. The spars 12, 12 are pivotally interconnected where they cross, for pivoting in a vertical plane. Likewise, the spars 16 are pivotally interconnected, where they cross, for pivoting in a horizontal plane.

Each hub member 14 at the front of the erected framework is connected with the directly opposing hub members 14, of the same vertical linkage, at the rear of the erected framework, by a helical tension spring 18, so that, in the erected framework, the tension springs 18 extend horizontally, from front to rear of the framework.

Figure 4:
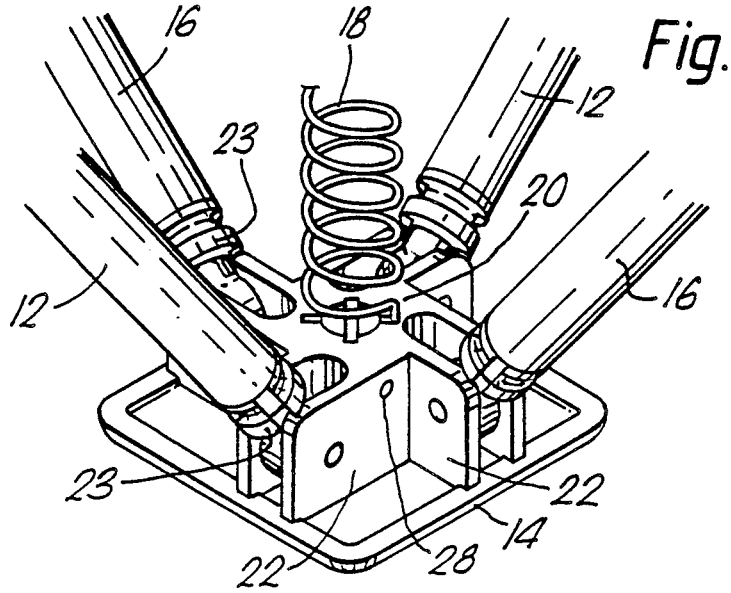
FIG. 4 is a perspective view showing a detail of the framework of FIGS. 1 to 3.
Figure 5:
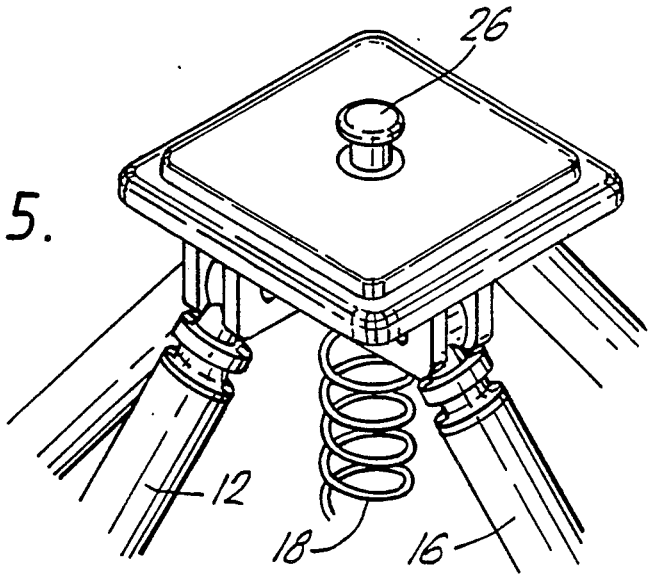
FIG. 5 is a perspective view substantially in the opposite direction from FIG. 5.

Referring to FIGS. 4 and 5, each hub member 14 has the general form of a square plate having a central boss 20 on one side from which four pairs of integral lugs 22 extend, to respective ones of the four edges of the square plate. The lugs 22 of each pair lie in respective planes perpendicular to the major plane of the plate and perpendicular to the respective edge of the plate to which they extend. Between the lugs 22 of each pair is received an eye part of a respective connection member 23, which is pivotally connected with the lugs, for pivoting in a plane parallel with the planes of the lugs, by a respective pivot pin passed perpendicularly through aligned holes in the lugs 22 of the pair and the hole in the eye part of the connection member. Each connection member 23 further includes a part, in the form of a serrated peg, which is received as a tight fit within a respective end of a respective metal tube forming the major part of the respective spar 16 or 12. Thus, each spar 12, 16 is pivotable with respect to the plate 14 about a respective one of four axes, each parallel with and adjacent to a respective edge of the plate. The planes of each pair of lugs 22 are off-set to one side of the respective parallel plane passing through the centre of the plate. This allows for the offset which exists between the spars of each pair of spars 12, 16 arising from the finite diameters of the spars and the fact that the spars are overlapped at their middles where they are pivotally connected. This offset thus eliminates the need for any flexing of the spars. A central bore extends through each plate 14, parallel to the major plane of the plate and through the central boss 20 thereof, this bore receiving a cylindrical metal peg 26 which projects from the face of the member 14 opposite the boss 20 and also receiving, in the region of the central bore provided in the boss 20, a looped end of the spring 18, which is retained by a metal pin 28 passed through the boss 20 to intersect said central bore diametrally. The spring 18 is thus retained against being pulled out from the central boss 20.

It will be appreciated that the hub members 14 at the top of each vertical linkage have no spars 12 extending upwardly therefrom and that the hub members 14 of the vertical linkages at opposite longitudinal ends of the erected framework do not have members 16 extending therefrom away from the adjoining vertical linkages.

Figure 6:
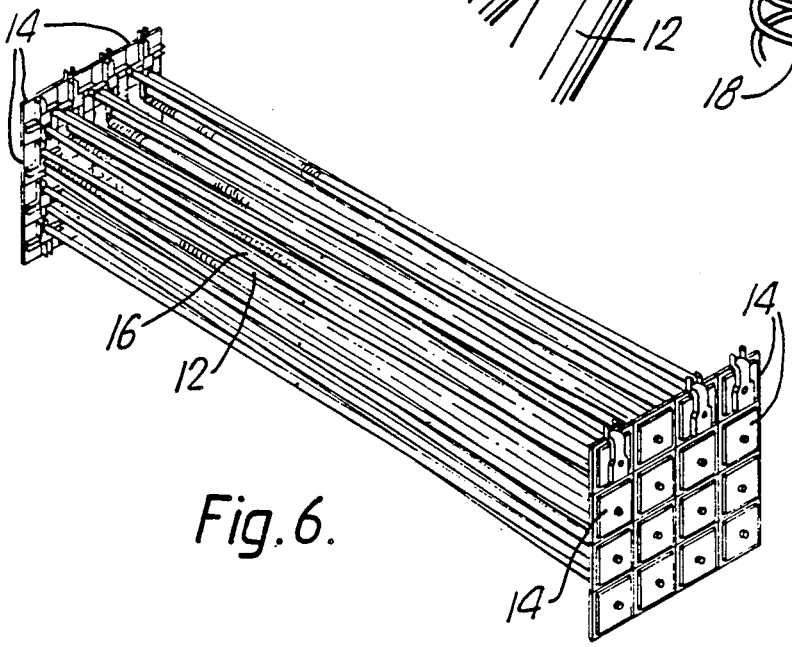
FIG. 6 is a perspective view showing the framework in a collapsed condition.

The framework can be folded, simply by relative pivotal movement of the spars such as to move the hub members 14 at the front of the frame away from the hub members 14 at the rear of the frame, into a compact bundle of the form shown roughly in FIG. 6 in which, for ease of drawings, no attempt has been made to represent accurately the course of each of the members 12, 16. In this folded condition, the hub members 14 at the front of the bundle effectively combine to form a composite rectangular end plate and the hub members 14 at the rear of the bundle likewise effectively combine to form a corresponding composite rectangular end plate, the spars 12, 16 and the springs 18 each extending from one of these composite end plates to the other. In this position, the springs 18 are fully extended, but the force of the springs is largely counteracted by compression in the struts 12, 16, which are almost perpendicular to the composite end plates in this state. However, by lifting the bundle by the uppermost set of struts 12, 16, whilst allowing the bundle to spread apart horizontally, the struts 12, 16 are allowed to pivot with respect to each other to allow the hub members 14 at the front and the rear of the bundle to spread apart upwardly and horizontally whilst the springs 18 contract drawing the hub members 14 at the front towards those at the rear. The springs 18 are so selected that the force of the springs as nearly as possibles balance the opposing forces due to the weight of the components as the framework is unfolded and so when the framework has been fully unfolded it can remain in its erected, unfolded state without external support.

The springs 18 are relied upon to hold the structure in its erected state only temporarily however. To fix the structure securely in its erected state, vertical bracing members are subsequently fitted, as described below.

Figure 7:
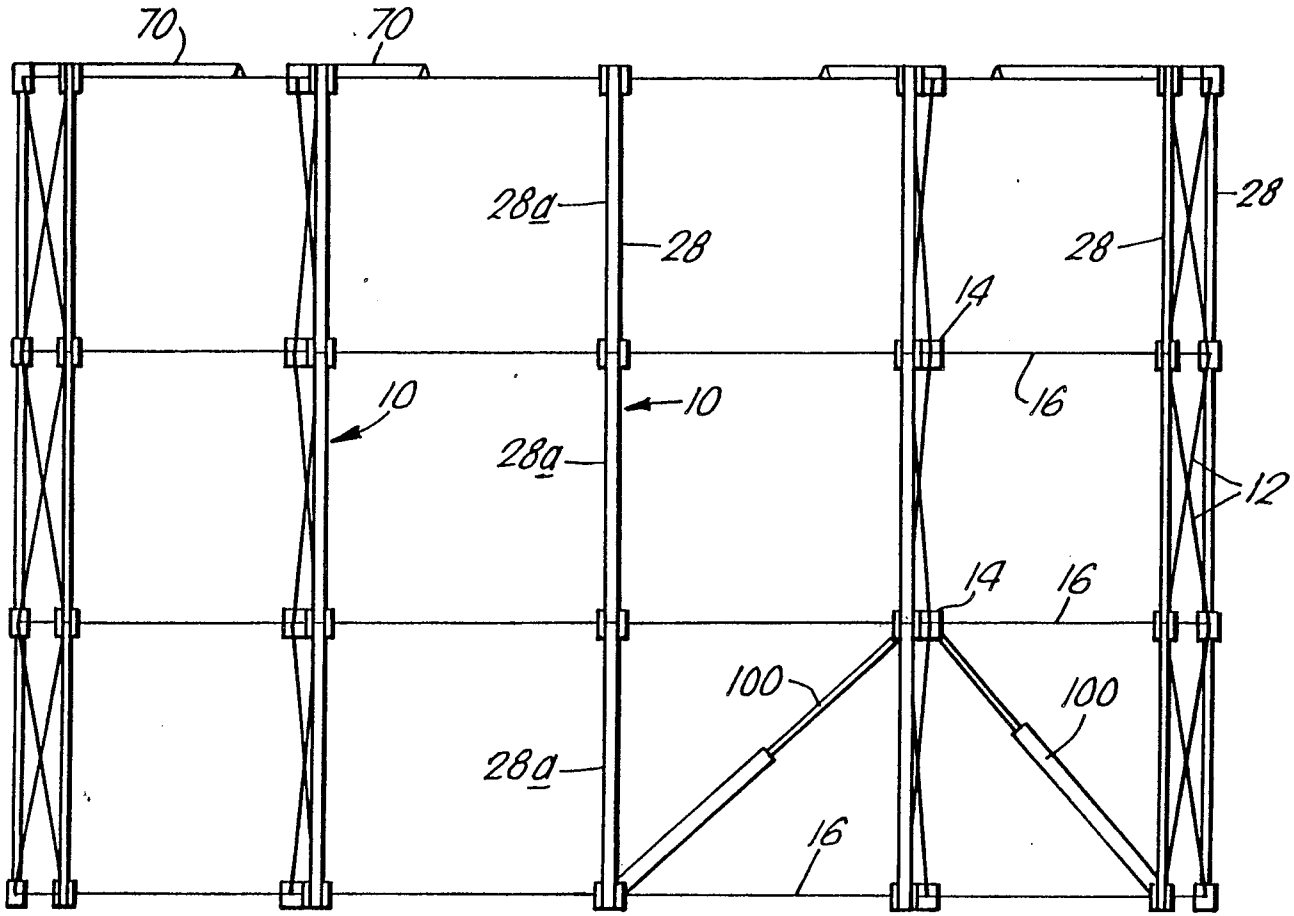
FIG. 7 is a schematic perspective view of the erected framework.
Figure 8:
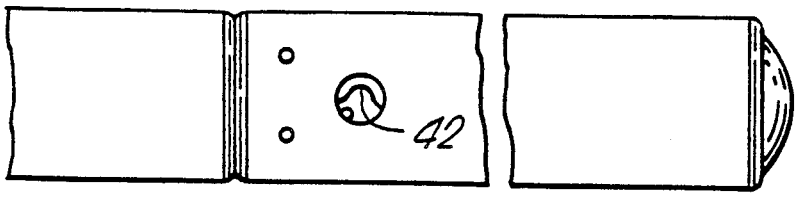
FIGS. 8, 9 and 10 are respectively fragmentary front elevation, side elevation and rear views of a bracing member.
Figure 9:
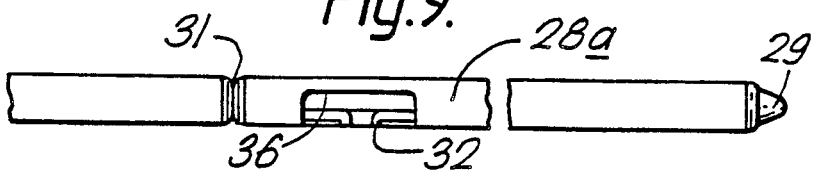
Figure 10:
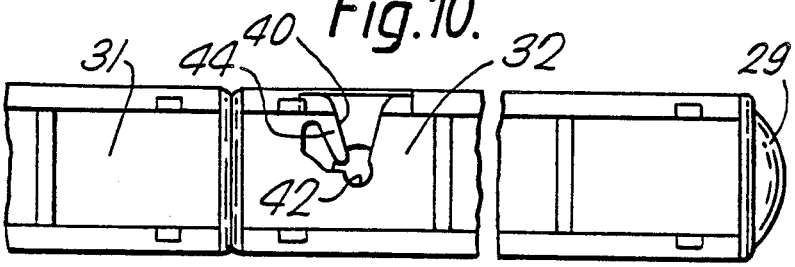
Figure 11:
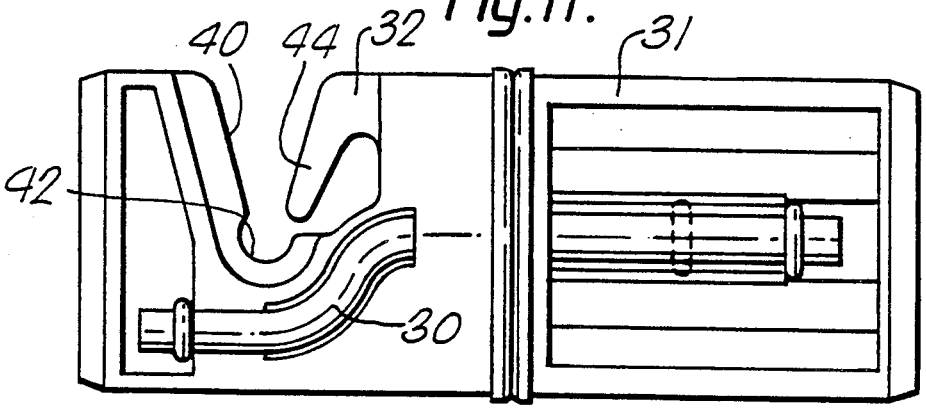
FIGS. 11 and 12 are elevation and sectional views respectively of cooperating connector elements for lengths of the bracing member of FIGS. 8 to 10.
Figure 12:
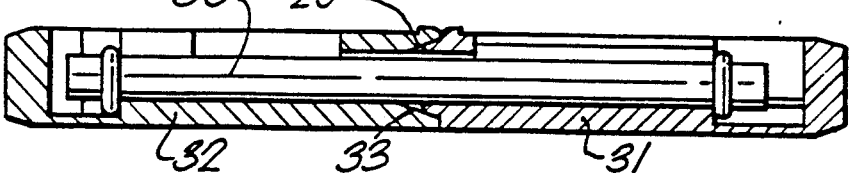
Figure 13:
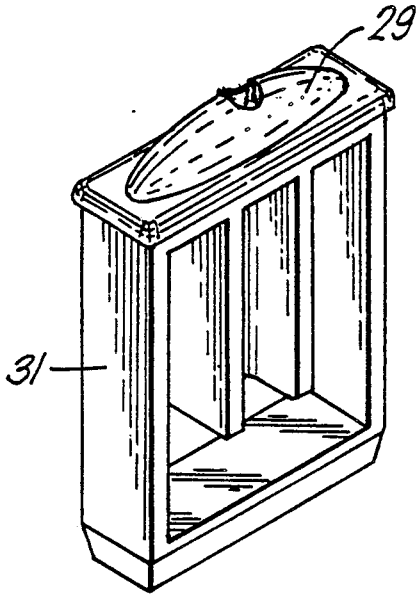
FIG. 13 is a perspective view of the male connector element of the elements of FIGS. 11 and 12.
Figure 14:
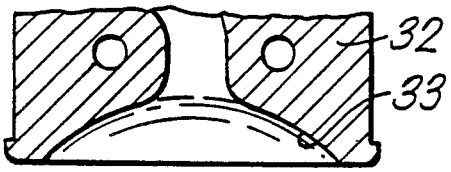
FIG. 14 is a fragmentary sectional vie of the female connector element of the elements of FIGS. 11 and 12, FIGS. 15 and 16 are respectively front and sectional views of the combination of an upper hub member of the framework and a bracket secured thereto.

As shown in FIGS. 2 and 7, a respective said bracing member 28 is provided for each of the vertical linkages, each bracing member extending over the whole height of the erected structure. Each bracing member 28 comprises a plurality of lengths **28*a*, fitted end to end, of a rolled steel channel-section extrusion, each said length 28*a* extending between one of the hubs 14 and the hub 14 directly above or directly below, at the front of the erected frame. As shown in FIGS. 8 to 10, each of said lengths of a bracing member 28 has at its upper end an upwardly projecting tapering tongue 29 and has at its lower end a downwardly open socket 33 (FIG. 14) to receive the tongue 29 at the upper end of the adjoining length 28*a*. The tongues and sockets are afforded by moulded plastics members 31 and 32 respectively secured within the respective ends of the channel-section lengths 28*a*. The members 31 and 32 are best shown in FIGS. 11 to 13. Adjoining lengths 28*a* of a bracing member 28 are interconnected by respective lengths 30 of elastic cord, each length 30 of cord extending through longitudinal bores in the respective members 31 and 32 and having its respective ends retained within the members 31 and 32. The arrangement is such that each elastic cord is still under some tension when the tongue of member 31 is fully engaged in the socket of member 32, yet can be stretched further to allow disconnection of the members 31 and 32 so that each brace 28 can be folded up in zig-zag fashion about the joints between respective lengths 28*a***.

As shown in FIGS. 9 and 10, each length 28*a* of a bracing member 28, adjacent its lower end, has its channel wall and flange cut away, on one side, as indicated at 36, in the region of the respective member 32 and the insert 32, on the same side, is provided with a slot 40 extending transversely into the member 32 from said one side, the slot 40 tapering in width from said one side to a central blind end of the slot, where the member 32 provides a part-cylindrical recess 42 adapted to fit snugly with the exterior surface of a peg 26. The bottom edge of the slot 40 is provided by a portion of the insert 32 which is in the form of an integral resilient finger 44, connected with the remainder of the member 32 at a position adjacent the cutaway side of the brace length 28*a* and terminating, at its free end, adjacent the recess 42. In assembly of the frame, with the framework expanded and the brace member length 28*a* already flexibly attached at its upper end to the length 28*a* above, or to a fitment at the top of the frame (see below) is swung laterally into cooperation with the projecting peg 26 of the plate 14 to which it is to be attached, so that the peg 26 enters the opening 36 and passes along the slot 40 to engage in the blind end 42. The narrowest end of the slot 40 is somewhat narrower than the diameter of the peg 26 so that the arm 44 is displaced resiliently to allow the peg 26 to pass and springs back when the peg is fully engaged with the concave surface at the blind end 42 whereby the arm 44 holds the peg 26 in place. The thickness of the portions of member 32 which define the slot 40, as measured in a direction from the front to the rear of the assembled frame, corresponds substantially with that of a peripheral annular groove around the stud 26. The portions of member 32 defining the slot 40 are thin plate-like parts set rearwardly relative to the base of the channel member 28*a* to define a cavity behind the base of the channel member and in front of these plate-like parts to receive the end portion of the peg 26 extending forwards of the peripheral groove, when these plate portions are engaged in the peripheral groove around the peg 26.

Figure 15:
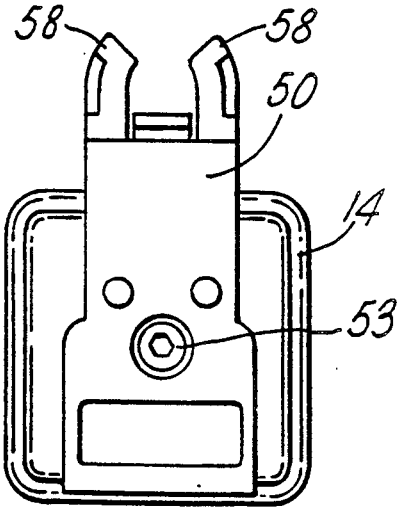
Figure 16:
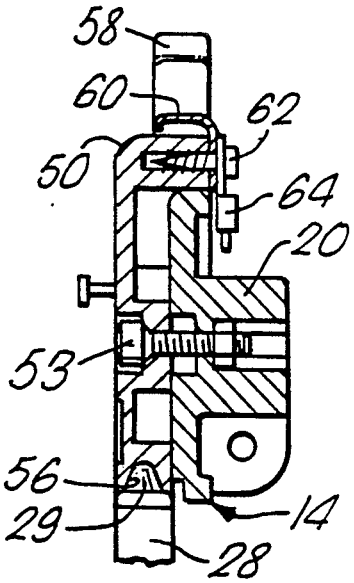

Referring to FIGS. 15 and 16, the uppermost plate 14 at the front of each vertical linkage carries a bracket member 50 secured to the front face of the plate 14 by a central bolt 53 which replaces the pegs 26 used in the lower plates 14. The bracket 50 provides, at its lower end, a socket 56 corresponding in form to the sockets in the members 32 at the lower ends of the brace lengths 28*a*. The socket 56 serves to receive the tongue 29 at the upper end of the uppermost brace part 28*a*. At its upper end, the bracket 50 carries a pair of upwardly extending jaws 58 which curve in towards one another somewhat towards their upper ends. Extending between the jaws 58, in the lower region of the space between the jaws 58, is a generally horizontal part of a resilient metal contact blade 60, a vertical leg of which is secured to the rear face of the member 50 by a screw 62 which also clamps against the contact plate a connector 64 connected with an electricity supply conductor.

Figure 17:
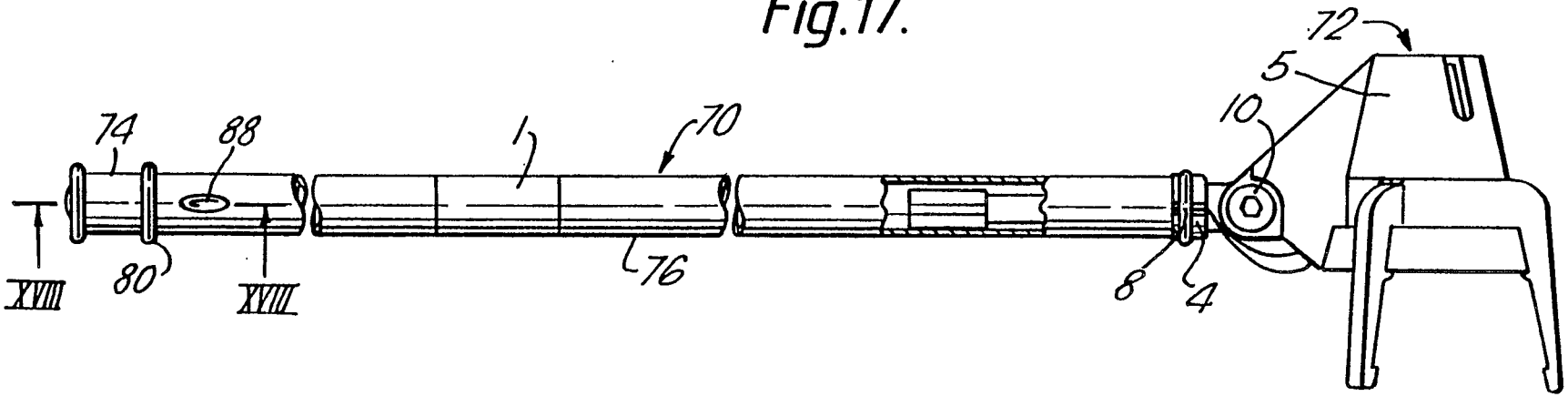
FIG. 17 is a fragmentary elevation view of a light fitting.
Figure 18:
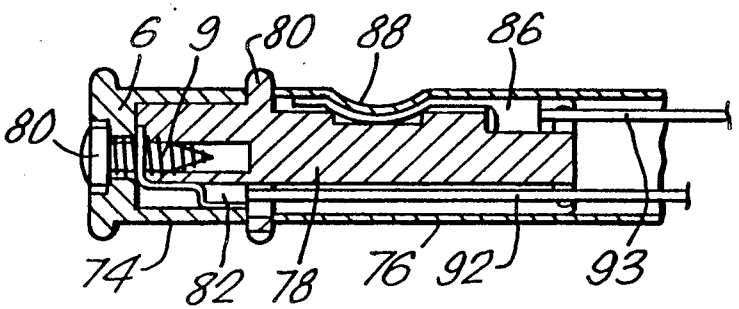
FIG. 18 is a sectional view of a detail of the light fitting of FIG. 17.

The uppermost plate 14 at the rear of each vertical linkage is similarly fitted with an identical bracket 50, the two brackets 50 being arranged in substantially mirror-image relationship with one another. The two brackets 50 at the top of each vertical linkage are adapted to receive, in their jaws, a respective arm of a light fitting for that vertical linkage. As shown in FIGS. 17 and 18, the arm 70 is a straight, externally cylindrical member carrying at one end a light fitting 72 pivotally connected to that end of the arm for pivoting about an axis perpendicular to the longitudinal axis of the arm, the fitting 72 incorporating a socket for an electric light bulb. The arm 70 is dimensioned to be a snap-fit between the jaws 58 of each of the brackets 50 whereby, when fitted, the arm 70 extends horizontally across the top of the erected frame, with its end remote from the fitting 72 held in the jaws 58 of the rearmost bracket 50 and an intermediate portion of the arm 70 held between the jaws of the forwardmost bracket 50 whereby the arm 70 projects forwardly from the assembled frame, allowing the lamp 72 to direct light towards display material on the front of the assembled frame (see below).

In order to avoid the necessity of providing loose conductors for the light fittings which must be connected up with supply conductors after the arm has been fitted, the arm 72 is also arranged to conduct electricity to the light fitting.

Thus, the rear end of the arm 70, which is gripped in the rearmost set of jaws 58, is afforded by a cylindrical metal contact cap 74 which is electrically insulated from the metal tube 76 which forms the remainder of the arm 70, by an insulating insert 78 of plastics having a portion which is received within the rear end of the tube 76 and is secured thereto and a portion which is received within the cap 74. The insert 78 has a collar 80 which extends between and separates the adjoining ends of the tube 76 and the cap 74. The cap 74 is secured to the insert 78 by a screw 80 extended axially into the insert 78 and which also serves to make electrical contact between the cap 74 and an electrical connector 82 fitted within the cap and connected by an insulated conductor 92 extended through the collar 80 and within and through the remainder of the tube 70, to the fitting 72. A further electrical connector 86, fitted within the tube 76 adjacent the rear end thereof, is maintained in electrical contact with the tube 76 by an indentation 88 formed in the tube after assembly and which also serves to secure the insert 78 within the tube 76. The connector 86 is likewise connected by an insulated conductor 93, extending through the tube 76 to the front end thereof, with the light fitting 72. When the arm 70 is fitted in its respective set of brackets, the contact plate 60 of the rearwardmost bracket engages the cap 74 whilst the contact 60 of the forwardmost bracket engages the surface of the tube 76 at a predetermined region thereof adapted to form a good electrical contact with the plate 60.

Figure 19:
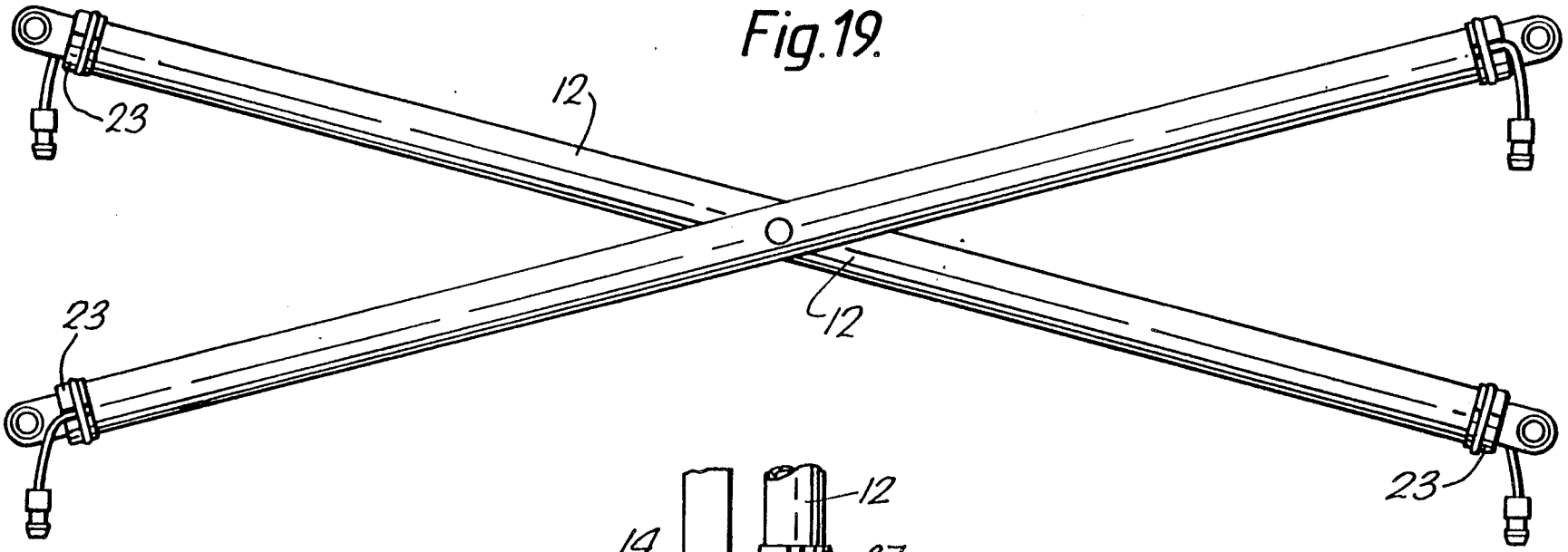
FIG. 19 shows a pair of pivotally connected spars forming part of the framework.
Figure 20:
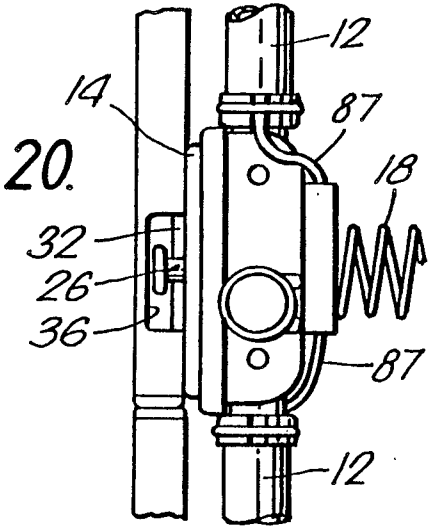
FIG. 20 is a side elevation view of a detail of the framework, showing the disposition of electrical conductors.

The supply of electricity to the arm 70 is effected, via the contact blades 60, through insulated conductors extended through the tubular struts which form the linkages (see FIG. 19). For ease of manufacture, a respective insulated electrical conductor 87 is extended through each of the tubular spars 12, and two insulated conductors 87 are extended through each of the spars 16, each said conductor projecting at its ends from the respective spar and terminating in respective connectors at its projecting ends. As shown in FIG. 20, the appropriate conductors are interconnected by complementary connector elements on the inner sides of the respective plates 14.

Each connection member 23 has laterally extending grooves along opposite sides thereof for passage of such insulated conductors 87 from the interior of the tube to the outside. The system of electrical conductors is connected to the output of a low voltage transformer (not shown) by way of leads extending from the lowermost plate 14 at the front and rear of one of the vertical linkages from respective sets of connectors located on the inner sides of the plates 14.

The vertical brace members 28, being of steel, afford a ready means of securing cladding sheets to the front of the frame by magnetic means. Thus, each cladding sheet may be a length of flexible sheet material, which can be rolled up for transportation and storage and which is of a width to span, with some overlap, the space between adjoining braces 28 in the assembled frame, and each such cladding sheet may carry magnetic fastener elements along its vertical edges, so that, in use, when the frame has been erected, the cladding sheets can simply be unrolled and their vertical edges placed against front surfaces of the braces 28 to be held magnetically in position against the same.

Figure 21:
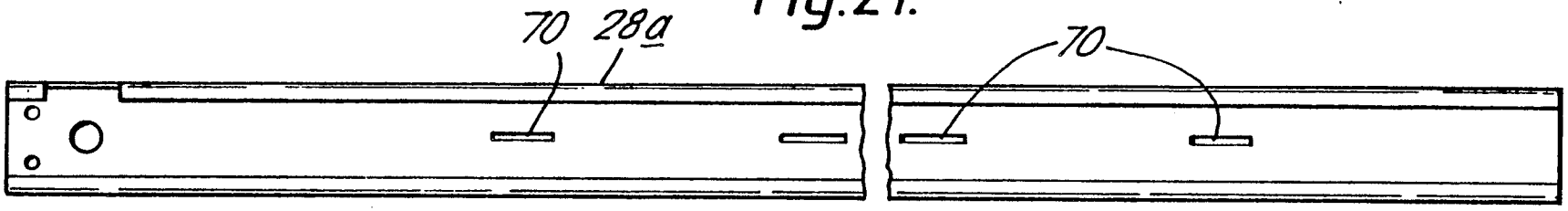
FIGS. 21, 22 and 23 are rear, side and sectional views of a length of a bracing member.
Figure 22:
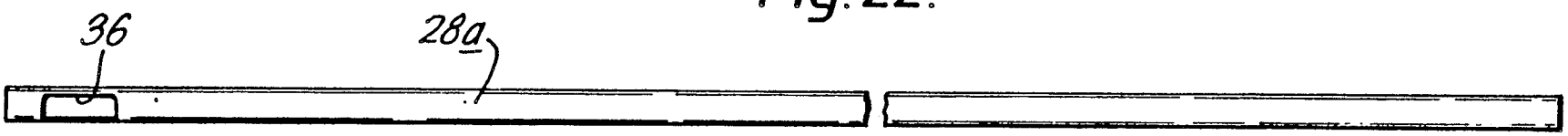
Figure 23:
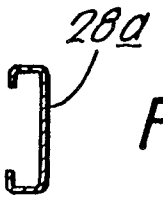

The braces 28 are also provided, at intervals along their length, with longitudinal slots 70 (see FIG. 21) which allow shelf brackets 72 (FIG. 24) of sheet metal, to be releasably fitted to the braces 28, in a vertical orientation, by means of tabs 74 of the brackets, which can be inserted through selected slots 70 and which have vertical slots 76 which receive the sheet material of the brace 28 at the lower ends of the respective slots, when the brackets, after insertion, are slid downwardly, thereby retaining shelf brackets on the braces 28. The widths of the cladding sheets are such as to leave the centrally located slots 70 to remain exposed between adjoining edges of adjoining said cladding sheets, to receive the brackets 72 where desired.

Figure 24:
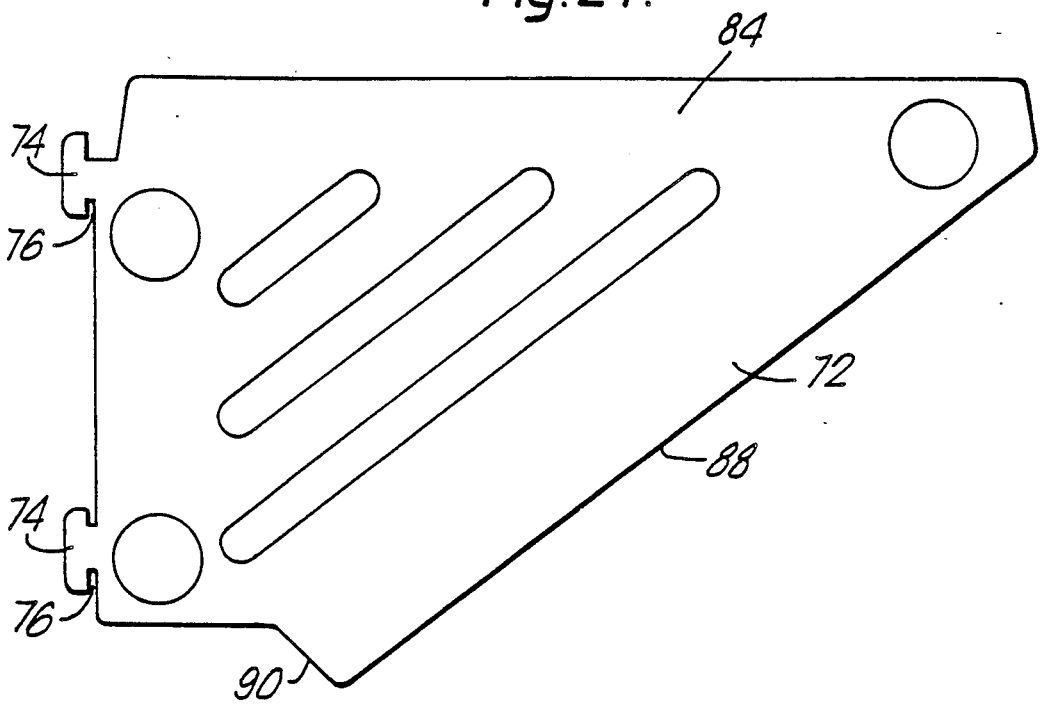
FIG. 24 is an elevation view of a shelf bracket.
Figure 26:
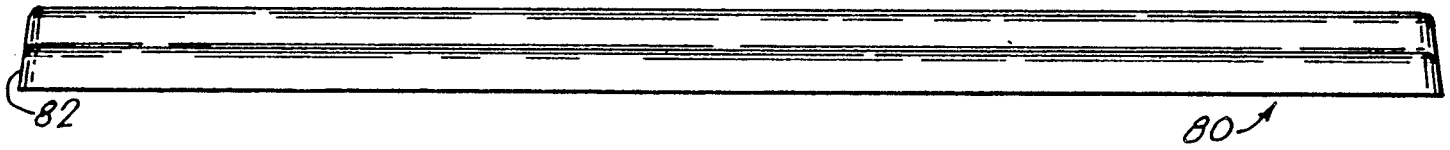
FIGS. 25 and 26 are respectively an underneath plan view and a front view of a shelf.
Figure 25:
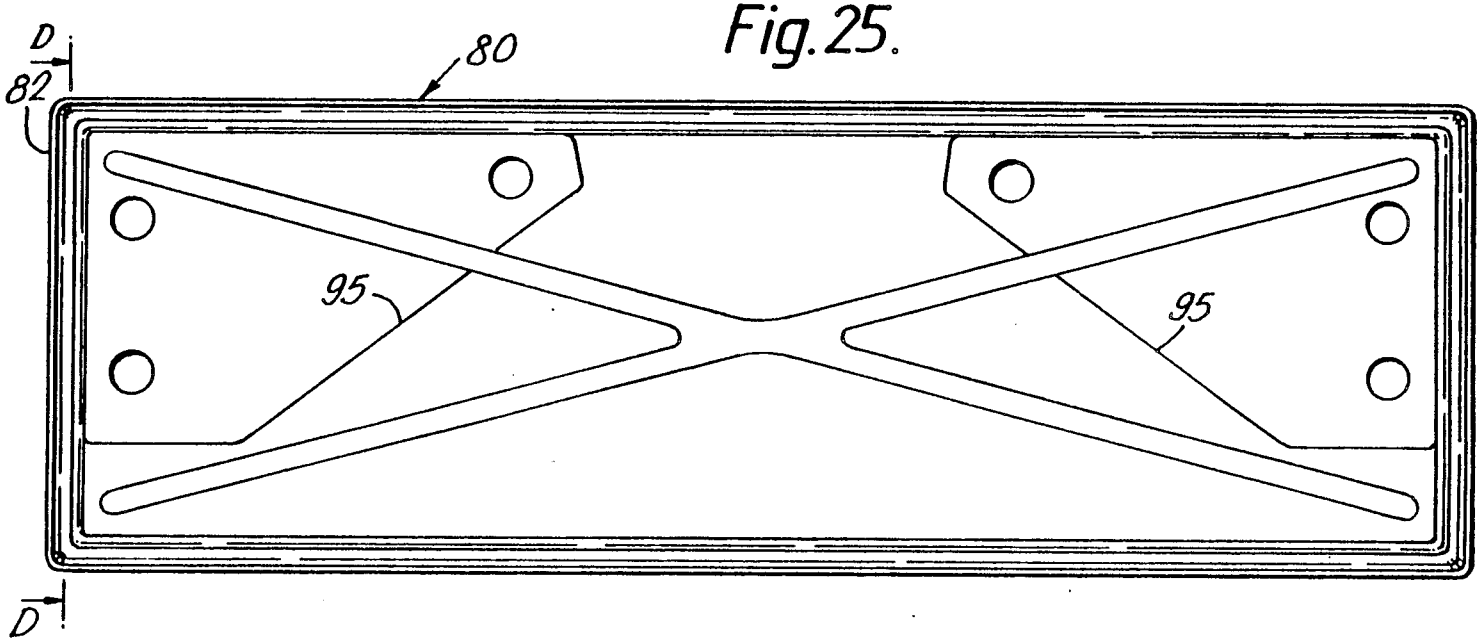
Figure 27:
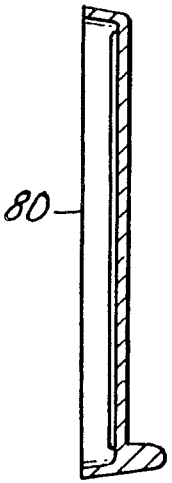
FIG. 27 is a view in section on the line D—D of FIG. 25

The brackets are intended to support shelves 80 in the form of moulded plastics trays of the form shown in FIGS. 25 to 27 provided with a recess on the underside, around the periphery, inside a downwardly extending peripheral skirt 82. As shown in FIG. 25, the upper tab 74 has an upwardly open slot on its upper edge adapted to receive the skirt 82 at the rear of the shelf, whilst the upper edge portion 84 of the bracket extends within the recess on the inner side of the skirt 82 along the respective shorter edge of the shelf. The upper edge of the bracket 72, as viewed in FIG. 24, is horizontal, so that, when fitted as described, the shelf is also horizontal. However the brackets 72 may alternatively be fitted upside down, as compared with FIG. 24, the slots on the upper edges (as viewed in FIG. 24) of the tabs 74 in this case fitting over the sheet material at the lower edges of the slots 70 in this case. In this arrangement an inclined edge 88 of each bracket is presented upwardly. The bracket is formed with a right angled shoulder 90, at the top, rear end of edge 88, for engagement by the inner surface of the skirt 82 at the rear of the shelf to retain the shelf when the latter is laid on the thus-inverted brackets, the shelf, in this case being inclined forwardly and downwardly, with the portions of the brackets adjoining edges 88 extending within the recesses on the inner side of the skirt 82 along the respective shorter edges of the shelf. The shelf has a moulded lip along its front edge, as shown in FIG. 27 to retain items thereon in this inclined position of the shelf. As shown in FIG. 27, the shelf has recesses 95 moulded in its underside, to receive the brackets 72 during transportation and storage. The faces of the brackets 72 and the bottoms of the recesses 95 are provided with complementary hook and pile fastener elements to retain the brackets in the recesses during transportion and storage.

The remaining drawings filed herewith show various components of the preferred embodiments in detail in various views, as will be evident from the foregoing without further explanation.

As shown in FIG. 7, it is preferable, for added strength, and to allow cladding sheets to be applied also to the vertical end "faces" of the frame, to provide each vertical linkage which provides a said end "face" with a brace 28 at the rear of the vertical linkage, as well as at the front of the linkage.

Figure 28:
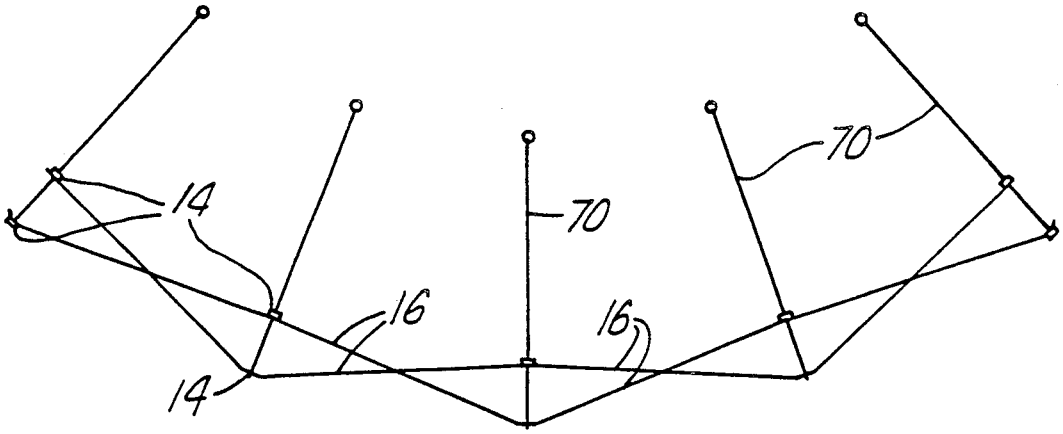
FIG. 28 is a schematic plan view of the assembled framework.

FIG. 28 is a schematic plan view of the erected framework shown in FIG. 7. It will be noted that whilst, in the foregoing description, it has been assumed, for convenience, that the erected frame is straight at front and back, in the sense that the hub members 14 at the front of the frame lie in a common plane and the hub members 14 at the rear of the frame lie in a parallel common plane, it will be appreciated that the nature of the framework is such that the vertical plane of each vertical linkage can be swung through a wide range of angles relative to the vertical plane of the adjoining vertical linkage, allowing the frame to be set along a generally curved path, as viewed in plan, and as illustrated in FIG. 28. In practice it is generally preferable to arrange for the frame to be "curved" in this way, for improved stability, as well as for aesthetic reasons.

To provide lateral stability, telescopic diagonal ties 100 may be provided, each extending from a respective hub member 14 at the front of the framework to a respective hub member 14, at the rear of the framework. The arrangement is such that, regarding the framework as an array of cells, each having six faces and four corners each defined at the junction of three adjoining mutually perpendicular said faces, each tie 100 extends between two corners of the cell which are opposite in the sense that they have none of said faces in common. The ties 100 are preferably located at the bottom of the frame and may be pivotally connected, at their ends, to respective stubs fitted in the respective hub members instead of springs 18 at these levels. As shown in FIG. 7, the arrangement of ties 100 is such that, as viewed from the front of the framework some ties 100 are inclined from bottom left to top right and some from top left to bottom right. The telescopic ties 100 each comprise an inner rigid rod slidable within an outer tubular sleeve, one end of the sleeve forming one end of the tie 100 and the inner rod projecting from the other end of the sleeve and providing, at its end remote from the sleeve, the opposite end of the tie 100. Cooperating stop means in the end of the sleeve from which the inner rod emerges and on the end of the inner rod within the sleeve limit extension of the rod from the sleeve. The ties 100 act in tension, being at their greatest extension when the framework is fully erected and being at their shortest when the framework is fully collapsed. The telescopic ties 100 may, if desired, be replaced by flexible filamentary elements such as wires, cables, tapes, cords, preferably with some means of controlling said elements in the collapsed condition of the framework. For example the filamentary elements may be secured at intervals to elastic filaments which are stretched progressively as the framework is extended and contract as the framework is collapsed to draw the filamentary elements into neat loops or bundles. Alternatively, the filamentary elements may have their one ends secured to respective spring tensioned drums, being fully unwound when the framework is erected and winding the filaments being wound up on said drums as the framework is collapsed.

We claim:

1. A collapsible framework comprising a plurality of spars pivotally connected with hub members, and with one another to form a two-dimensionally expanding linkage, and at least one upright brace, detachably connectable between at least one said hub member and an adjoining said hub member above it, to brace the linkage in an expanded condition and wherein said upright brace comprises a plurality of rigid lengths detachably connected end-to-end by plug and socket connections and by resilient tensioning means which serve to draw adjacent lengths into interfitting relationship when said lengths are aligned.

2. A collapsible framework according to claim 1 wherein said upright brace is of iron or steel whereby a cladding sheet having magnetic securing means thereon, can readily be attached to said brace.

3. A collapsible framework comprising a plurality of spars pivotally connected with hub members, and with one another to form a two-dimensionally expanding linkage, and at least one upright brace, detachably connectable between at least one said hub member and an adjoining said hub member above it, to brace the linkage in an expanded condition and wherein said hub members include first hub members which lie on a notional first surface of the erected framework and second hub members which lie on a notional second surface of the erected framework generally parallel with, and spaced from said first surface, each said first hub member being connected, via the spars extending therefrom, with respective said second hub members, and conversely, each said first hub member being directly opposed by a respective said second hub member the spars of which are pivotally connected with the spars of the opposing first hub member, and each said first hub member being connected with the opposing said second hub member by a resiliently extensible tensioning element.

4. A collapsible framework according to claim 3 wherein said upright brace is of iron or steel whereby by a cladding sheet having magnetic securing means thereon can readily be attached to said brace.

* * * * *